United States Patent [19]

Saulgeot et al.

[11] Patent Number: 5,039,280

[45] Date of Patent: Aug. 13, 1991

[54] PUMP ASSEMBLY FOR OBTAINING A HIGH VACUUM

[75] Inventors: Claude Saulgeot, Veyrier-du-Lac; Jacques Long, Annecy, both of France

[73] Assignee: Alcatel CIT, Paris, France

[21] Appl. No.: 566,332

[22] PCT Filed: Sep. 27, 1989

[86] PCT No.: PCT/FR89/00494

§ 371 Date: Aug. 14, 1990

§ 102(e) Date: Aug. 14, 1990

[87] PCT Pub. No.: WO90/07061

PCT Pub. Date: Jun. 28, 1990

[51] Int. Cl.[5] ..... F04B 23/08

[52] U.S. Cl. ..... 417/205; 417/2

[58] Field of Search ..... 417/62, 205, 244, 2, 417/199.1, 201, 199.2, 202, 203, 206

[56] References Cited

U.S. PATENT DOCUMENTS 2,492,075 12/1949 Van Atta ..... 417/62

4,770,609 9/1988 Uchida et al. ..... 417/2

*Primary Examiner*—Leonard E. Smith

*Assistant Examiner*—Charles G. Freay

*Attorney, Agent, or Firm*—Sughrue, Mion, Zinn, Macpeak & Seas

[57] ABSTRACT

A pumping assembly for obtaining a high vacuum, the assembly comprising a primary pump (4) and a secondary pump (1) associated in series, the inlet of the secondary pump (1) being taken from an enclosure (3) to be evacuated, the assembly further including means (7) for starting the secondary pump (1) when the pressure upstream from the primary pump (4) drops below a value $P_1$, the assembly being characterized in that a passive tank (10) followed by an isolating valve (11) are interposed between the outlet (12) from the secondary pump (1) and the inlet (13) to the primary pump (4), and in that it includes control means (7) for closing the isolating valve (11) and stopping the primary pump (4) when the pressure in said passive tank (10) reaches a value $P_2 < P_1$, and for opening the isolating valve (11) and restarting the primary pump (4) when the pressure in said passive tank (10) returns to the pressure $P_1$.

2 Claims, 1 Drawing Sheet

PUMP ASSEMBLY FOR OBTAINING A HIGH VACUUM

The present invention relates to a pump assembly for obtaining a high vacuum.

It is well known that in order to obtain pressures of less than $10^{-3}$ mbar, a primary pump is associated in series with a secondary pump. When the assembly is started up, only the primary pump is run until the pressure upstream from the primary pump has dropped to a value $P_1$ enabling the secondary pump to operate. The secondary pump is then started and both pumps, i.e. the primary pump and the secondary pump operate simultaneously, in series, and permanently. The desired pressure in the enclosure is thus achieved after some length of time has elapsed.

Such a pumping assembly requires electricity to feed the motors driving the pumps. The electricity may be taken either from a mains supply or else from a storage battery integrated in the pumping assembly.

The object of the invention is to economize the electrical energy consumed during pumping operations. The invention is particularly advantageous for portable assemblies which are powered, in particular, from storage batteries, the invention making is possible to increase the running time of the pumping assembly for a battery of given size and weight.

The present invention thus provides a pumping assembly for obtaining a high vacuum, the assembly comprising a primary pump and a secondary pump associated in series, the inlet of the secondary pump being taken from an enclosure to be evacuated, the assembly further including means for starting the secondary pump when the pressure upstream from the primary pump drops below a value $P_1$, the assembly being characterized in that a passive tank followed by an isolating valve are interposed between the outlet from the secondary pump and the inlet to the primary pump, and in that it includes control means for closing the isolating valve and stopping the primary pump when the pressure in said passive tank reaches a value $P_2<P_1$, and for opening the isolating valve and restarting the primary pump when the pressure in said passive tank returns to the pressure $P_1$.

Figure 1:
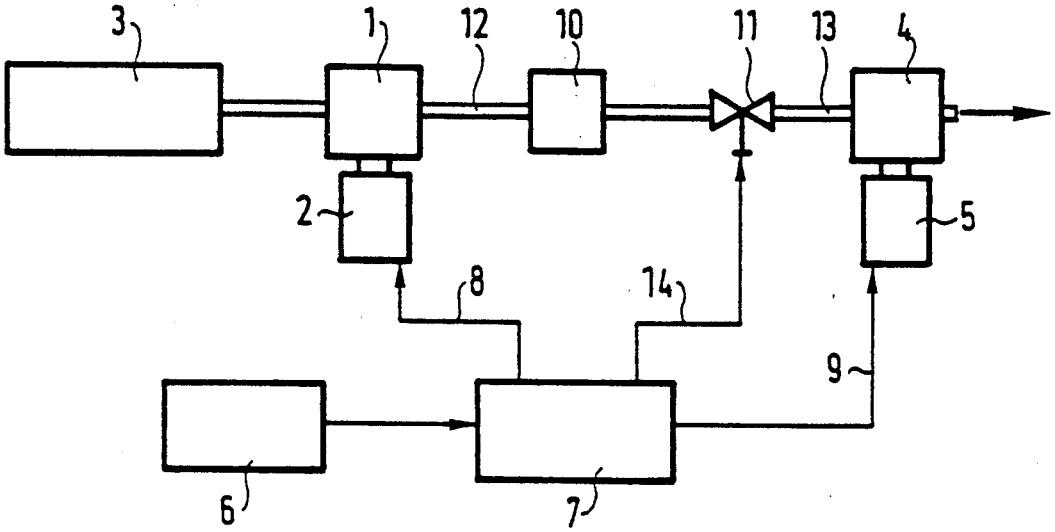
Figure 2:
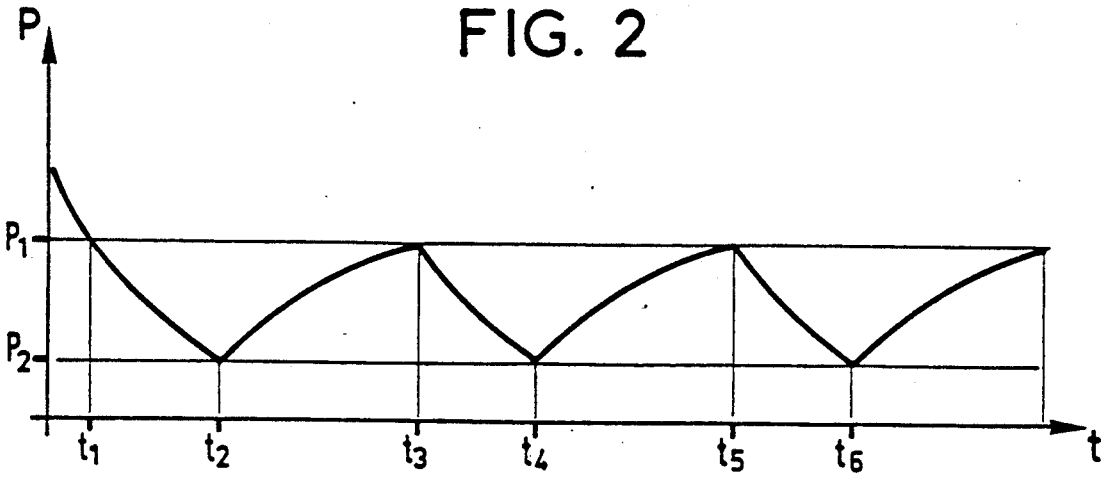

An embodiment of the invention is now described by way of example with reference to the accompanying drawing, in which:

FIG. 1 is a block diagram of a pumping assembly in accordance with the invention; and FIG. 2 is a curve representative of the operation of the pumping assembly.

FIG. 1 is thus a block diagram of a pumping assembly comprising a secondary pump 1 having a drive motor 2 having its inlet side connected to an enclosure in which a high vacuum is desired, and having its outlet side connected to a primary pump 4 having a drive motor 5, said primary pump 4 outputting to the atmosphere.

The pumping assembly shown is, for example, portable and cordless, and therefore includes a storage battery 6 for powering the assembly. The battery feeds an electrical control circuit 7 which includes, inter alia, a DC-AC converter for providing a 3- phase AC to the motors 2 and 5. Lines 8 and 9 represent these power supply connections.

As is known, the secondary pump 1 cannot operate unless below a certain pressure $P_1$ referred to as the priming pressure. Thus, when the assembly is initially started, only the primary pump 4 is switched on, and the secondary pump is started automatically when the pressure upstream from the primary pump falls below said pressure $P_1$. It is known that the current taken by the drive motor 5 is an increasing function of inlet pressure. Thus, the secondary pump is switched on when the current taken by the drive motor 5 drops below a value which corresponds to said priming pressure $P_1$. To this end, the control circuit 7 includes a current-sensitive relay, for example, switching at a predetermined value of the current taken by the line 9.

According to the invention, a passive tank 10 followed by an isolating valve 11 are interposed between the outlet 12 from the secondary pump 1 and the inlet 13 to the primary pump 4. The passive tank 10 is merely a cavity having a certain volume, that is why it is called "passive".

The control circuit 7 includes a relay which operates between two values of the current taken by the drive motor 2 on the secondary pump 1: a maximum value $I_1$ and a minimum value $I_2$, which values correspond to two values of the pressure P in the isolating tank 10: the first value corresponding to the priming pressure $P_1$, and the second value corresponding to a pressure $P_2<P_1$. The pressure $P_2$ corresponds to a value $P_l$ for the pressure in the vacuum enclosure 3. This pressure $P_l$ is the limiting inlet pressure for the secondary pump 1.

Thus, once the pressure in the tank 10 reaches the value $P_2$, the control circuit 7 closes the valve 11 via the line 14 and switches off the drive motor 5 of the primary pump 4. Conversely, when the pressure in the isolating tank 10 rises to the value $P_1$ by virtue of the secondary pump 1 continuing to operate and the walls of the enclosure 3 degassing, the control circuit 7 reopens the isolating valve 11 and switches back on the primary pump 4. The pressure in the tank 10 drops again to the value $P_2$, thereby switching off the primary pump 4 again and reclosing the isolating valve 11. The pressure in the isolating tank 10 thus oscillates between the two values $P_1$ and $P_2$, so that during a first period of time both pumps are in operation and during a second period of time only the secondary pump is in operation.

FIG. 2 shows this operation.

From time 0 to time $t_1$, the pumping assembly is started up and only the primary pump 4 is in operation. At time $t_1$, the pressure in the tank 10 reaches the value $P_1$ and the secondary pump 1 is switched on. At this moment, the current taken by its drive motor 2 is at a maximum and is equal to $I_1$. The pressure falls down to $P_2$ at time $t_2$, with the current taken by the motor 2 also falling down to its minimum value $I_2$, thereby triggering the relay so that the primary pump 4 is stopped and the valve 11 is closed. From time $t_2$ to $t_3$, only the secondary pump is in operation. At $t_3$, the primary pump is restarted and the valve 11 is reopened, etc. . . . From $t_3$ to $t_4$, both pumps are in operation, from $t_4$ to $t_5$, only the secondary pump 1 is in operation . . .

If the pumping flow Q is defined as the product of its volume rate S multiplied by the pressure P of the pumped flow, then $Q=PS$.

It is specified above that the pressure $P_2$ is the pressure in the tank 10 when the inlet side of the secondary pump 1 reaches its limiting pressure $P_1$. At this moment, conditions are steady, and the flow Q pumped through the primary pump 4 is equal to the outgassing flow $Q_1$ in the enclosure 3.

At this moment, the flow pumped by the primary pump is $Q=P_2 \cdot S=Q_1$, where S is the volume rate of the primary pump 4. This gives $P_2=Q_1/S$.

The ratio of on-time to off-time for the primary pump 4 is directly related to the degassing flow $Q_1$ in the enclosure 3 and to the magnitude of the volume V of the tank 10. These two magnitudes are related by the following equation:

$$P_1-P_2=ta.Q_1/V$$

where:

ta is the stop time of the primary pump 4 (i.e. $t_3-t_2$ or $t_5-t_4$ in FIG. 2). Thus:

$$ta=V(P_1-P_2)/Q_1.$$

Thus, the stop times increase with increasing volume V in the tank 10, with increasing priming pressure $P_1$ for the secondary pump 1, and with decreasing degassing flow $Q_1$ from the enclosure 3.

In addition, the on-time tm of the primary pump 4 (corresponding to times $t_2-t_1$ or $t_4-t_3$ or $t_6-t_5$ in FIG. 2) depends on the volume V of the tank 10 and on the volume rate S of the primary pump 4.

These quantities are related by the following equation:

$$tm=2.3(V/S)log(P_1/P_2).$$

Thus, the on-time of the primary pump 4 decreases with decreasing volume V of the tank 10, with decreasing pressure ratio $P_1/P_2$, and with increasing volume rate S of the primary pump 4.

This gives:

$$\frac{tm}{ta}=\frac{2.3(V/S)\log(P_1/P_2)}{V(P_1-P_2)/Q_1}=\frac{2.3(Q_1/S)\log(P_1/P_2)}{(P_1-P_2)}$$

Thus this ratio decreases with decreasing degassing flow $Q_1$ from the enclosure, with decreasing ratio $P_1/P_2$, with increasing volume rate S of the primary pump, and with increasing pressure difference $P_1-P_2$.

By way of example, if the volume rate S of the primary pump 4 is $S=3.6\ m^3/h=1$ liter/second, the degassing flow $Q_1=10^{-2}$ mb.liter/second, the maximum priming pressure $P_1=40$ mb, and the minimum pressure $P_2=4.10^{-3}$ mb, then tm=9.2 seconds and ta=4000 seconds, giving:

$$tm/ta=2.3/1000$$
$$tm/(tm+ta)=2.3/1002.3\approx 2.3\times 10^{-3}$$

Thus, the energy consumed by the primary pump 4 in such a pumping assembly during a period of time t during which the assembly is in use corresponds to $2.3\times 10^{-3}$ times the amount of energy that would have been consumed by the primary pump if the primary pump 4 had been operating throughout the period t, instead of operating intermittently. The primary pump operates permanently as from time $t_1$.

The advantage of the invention is thus clear, particularly when used with a cordless assembly powered by a battery.

The invention is also applicable to cases where the primary pump 4 is a fixing pump, e.g. a static pump of the zeolite or "molecular sieve" type. Pumping by capturing molecules is effective only at very low temperature and this type of pump requires a powerful cooling system, e.g. based on liquid nitrogen circulation.

In this case, there is no drive motor 5, since the motor is replaced by the cooling system. The control circuit 7 thus operates by switching on and off the cooling circuit 5 under the same conditions as it switches on and off the drive motor for a rotary pump that delivers to the atmosphere.

We claim:

1. A pumping assembly for obtaining a high vacuum, the assembly comprising a primary pump (4) and a secondary pump (1) associated in series, the inlet of the secondary pump (1) being taken from an enclosure (3) to be evacuated, the assembly further including means (7) for starting the secondary pump (1) when the pressure upstream from the primary pump (4) drops below a value $P_1$, the assembly being characterized in that a passive tank (10) followed by an isolating valve (11) are interposed between the outlet (12) from the secondary pump (1) and the inlet (13) to the primary pump (4), and in that it includes control means (7) for closing the isolating valve (11) and stopping the primary pump (4) when the pressure in said passive tank (10) reaches a value $P_2<P_1$, and for opening the isolating valve (11) and restarting the primary pump (4) when the pressure in said passive tank (10) returns to the pressure $P_1$.

2. A pumping assembly according to claim 1, characterized in that said primary pump is a fixing pump (4) provided with a cooling device (5), said means for stopping the primary pump (4) acting on the cooling device (5).

* * * * *